US005816461A

United States Patent [19]

Balcom

[11] Patent Number: 5,816,461

[45] Date of Patent: Oct. 6, 1998

[54] CARRYING ADAPTOR FOR A COMPOUND BOW

[76] Inventor: James Reed Balcom, 4718 S. University Dr., Fargo, N. Dak. 58104

[21] Appl. No.: 631,253

[22] Filed: Apr. 12, 1996

[51] Int. Cl.[6] ..... F41B 5/00; A45F 5/00

[52] U.S. Cl. ..... 224/269; 224/257; 224/268; 224/916; 124/88; 124/23.1

[58] Field of Search ..... 224/257, 258, 224/916, 268, 269, 271, 272, 251; 124/88, 23.1, 86; 24/600.6

[56] References Cited

U.S. PATENT DOCUMENTS 345,923 7/1886 Riggle ..... 24/600.6
967,486 8/1910 Avery ..... 24/600.6
2,656,580 10/1953 Javery ..... 24/600.6
5,239,976 8/1993 Specht ..... 224/257

*Primary Examiner*—Linda J. Sholl
*Attorney, Agent, or Firm*—David A. Lingbeck

[57] ABSTRACT

A carrying adaptor for a compound bow includes an elongate body member, a catch member securely fastened to the body member and having a hook-like member for receiving and holding a flexible support member such as a strap, and a sleeve slidably mounted upon the exterior of the body member for retaining the flexible support member with the hook-like member.

11 Claims, 5 Drawing Sheets

CARRYING ADAPTOR FOR A COMPOUND BOW

BACKGROUND OF THE INVENTION

This invention relates to a carrying adaptor for a compound bow which allows the user to suspend and carry the compound bow from a strap carried about the shoulder of a user instead of the user having to always hang onto and carry the compound bow with his hands and arms which, otherwise, would generally become tired and weary over a period of time.

A user who carries the compound bow with his arms and hands all day long especially on hunting trips will find that his hands and arms will become tired and that when the time comes to use the compound bow he may not have the same accuracy as he would have had with his arms not being tired. To provide some relief for his arms and hands, the user, at times, may extend his arm between the cable and the bow and put the compound bow around his shoulder and carry it in that manner or may instead use the prior art which describes a COMPOUND ARCHERY BOW HAVING A CARRYING ADAPTOR MOUNTED THEREON, U.S. Pat. No. 5,239,976, issued on Aug. 31, 1993 and invented by John J. Specht, which comprises a body portion having a first portion which has a bore extending therethrough and adapted to receive the cable bar on the compound bow, and further having a second portion which essentially extends perpendicular to the cable bar when the adaptor is mounted thereto and which has a groove for receiving a strap which is carried about the shoulder of the user. The adaptor is engaged to the cable bar with a threaded member which is threaded through the first portion and engaged to a portion of the cable bar. The second portion which extends outwardly from the cable bar tends to come into contact with the body of the user as the compound bow is suspended and carried by the strap. When this happens, there is nothing to prevent the strap from coming out of the groove resulting in the compound bow not being carried by the strap, problems of which are solved by the present invention.

SUMMARY OF THE INVENTION

The present invention relates to a carrying adaptor for a compound bow which comprises an elongate body member having a bore extending therethrough and being adapted to receive the end of the cable bar on a compound bow through a first end of the bore, the body member being fastenable to the cable bar with a threaded member. The carrying adaptor further comprises a flexible support catch member having a shaft with a hook-like member fixedly attached to one end of the shaft which has another end which engageably extends in the second end of the bore with the shaft being fastened with a fastener inside the bore. A sleeve is slidably mounted about the body member to substantially prevent the flexible support member such as a strap from accidentally becoming unhooked.

One objective of the present invention is to provide a carrying adaptor for a compound bow which allows the user to hook the cable on the compound bow to a strap mounted to the shoulder of the user for convenient carrying of the compound bow.

Another objective of the present invention is to provide a carrying adaptor for a compound bow which is simply an extension of the cable bar with the carrying adaptor staying generally within the lateral confines of the cable bar unlike the prior art.

Yet another objective of the present invention is to provide a carrying adaptor for a compound bow which prevents the accidental unhooking of the strap from the carrying adaptor also unlike the prior art.

Further objectives and advantages of the present invention will become apparent as the description proceeds and when taken in conjunction with the accompanying drawings wherein:

DETAILED DESCRIPTION OF THE INVENTION

Figure 1:
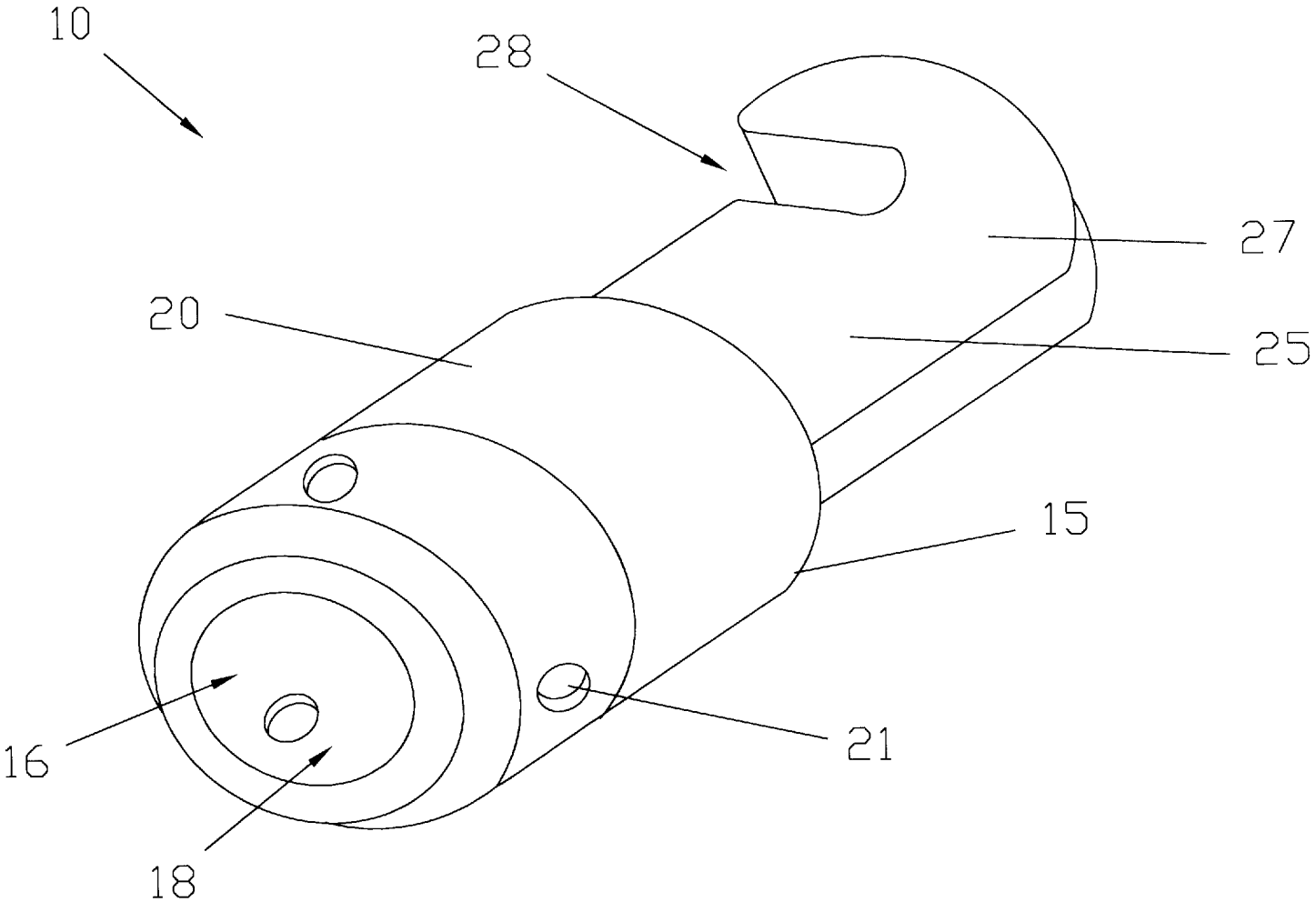
FIG. 1 is a perspective view of the carrying adaptor for a compound/bow.
Figure 2:
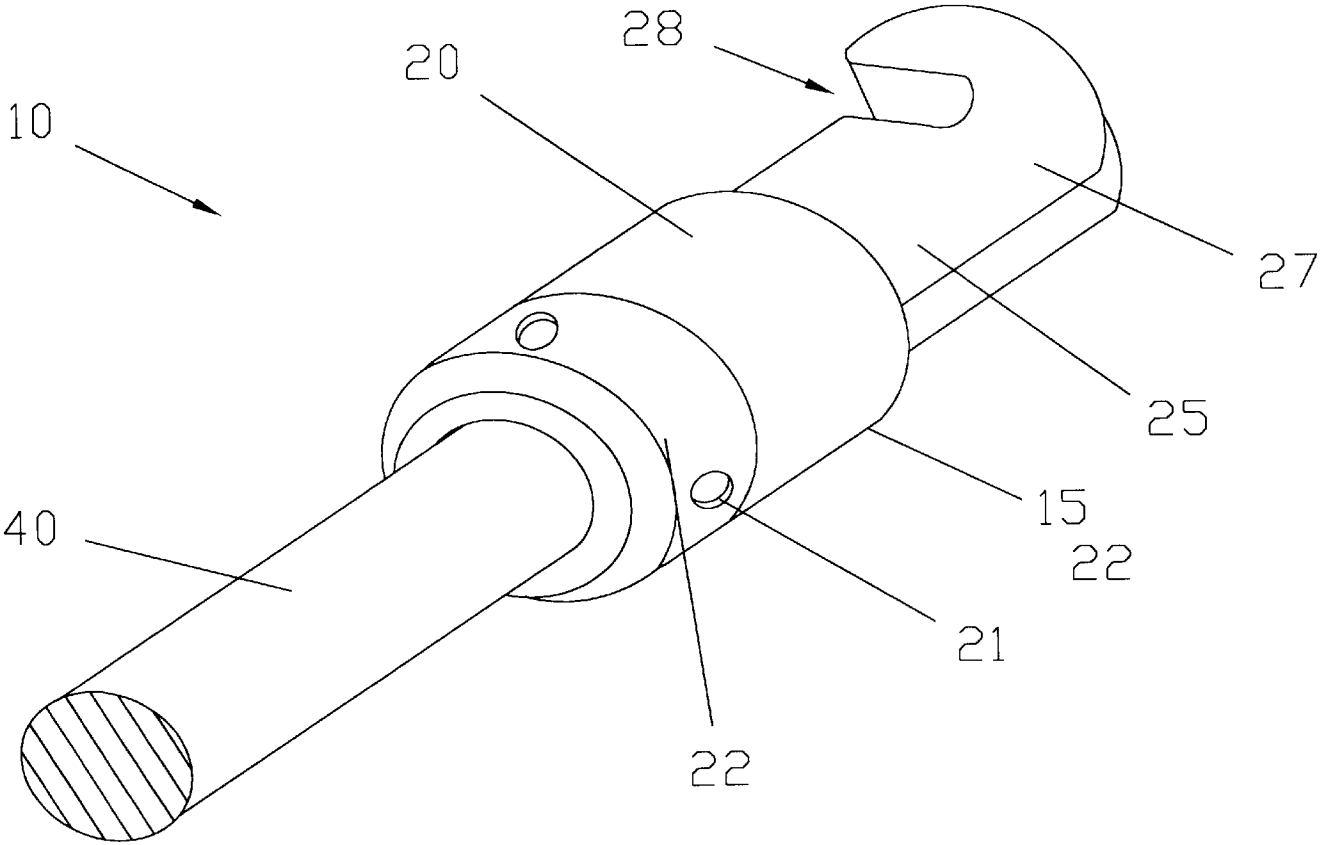
FIG. 2 is a perspective view of the carrying adaptor attached to the end of a cable bar for a compound bow.
Figure 3:
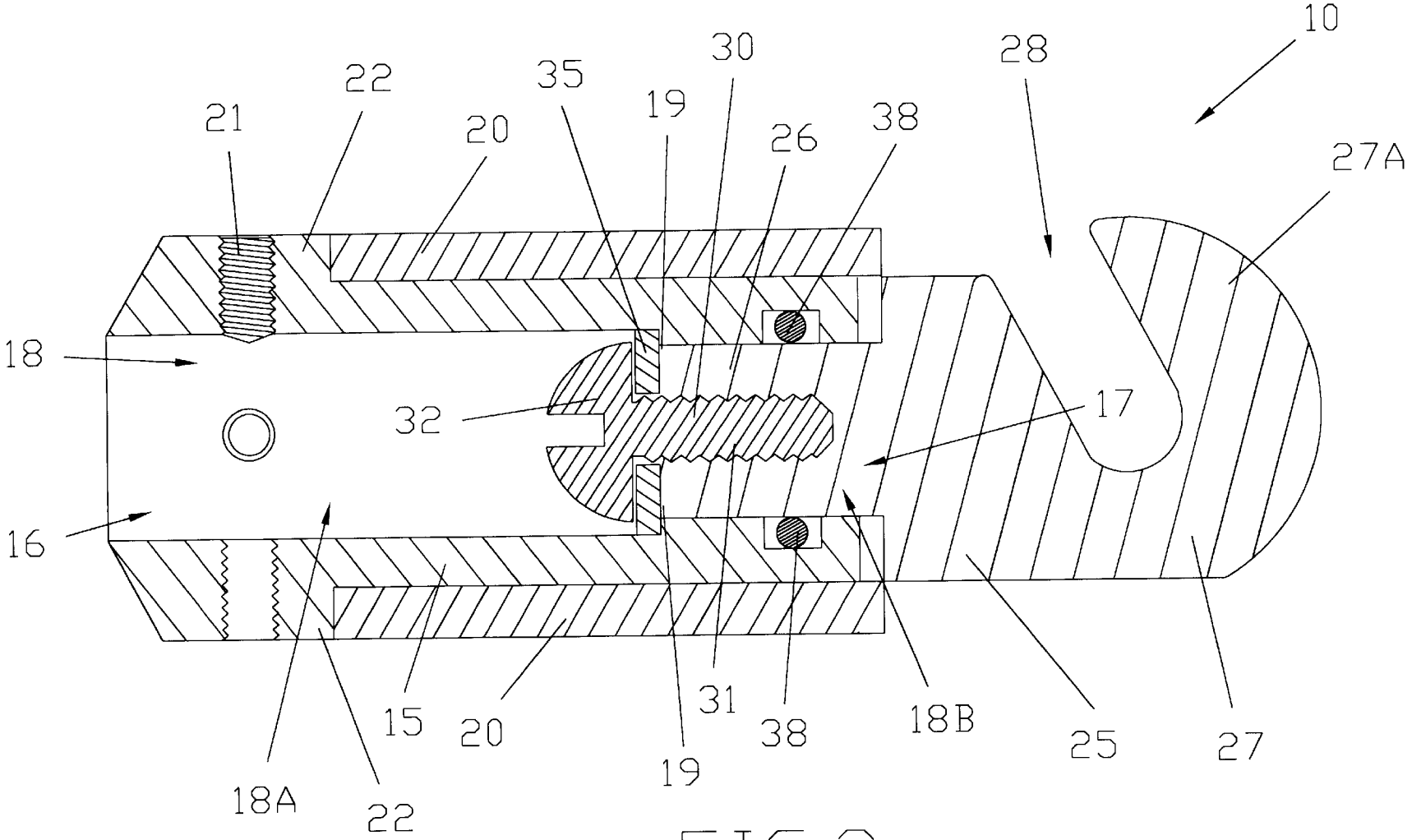
FIG. 3 is a side cross-sectional view of the carrying adaptor.
Figure 4:
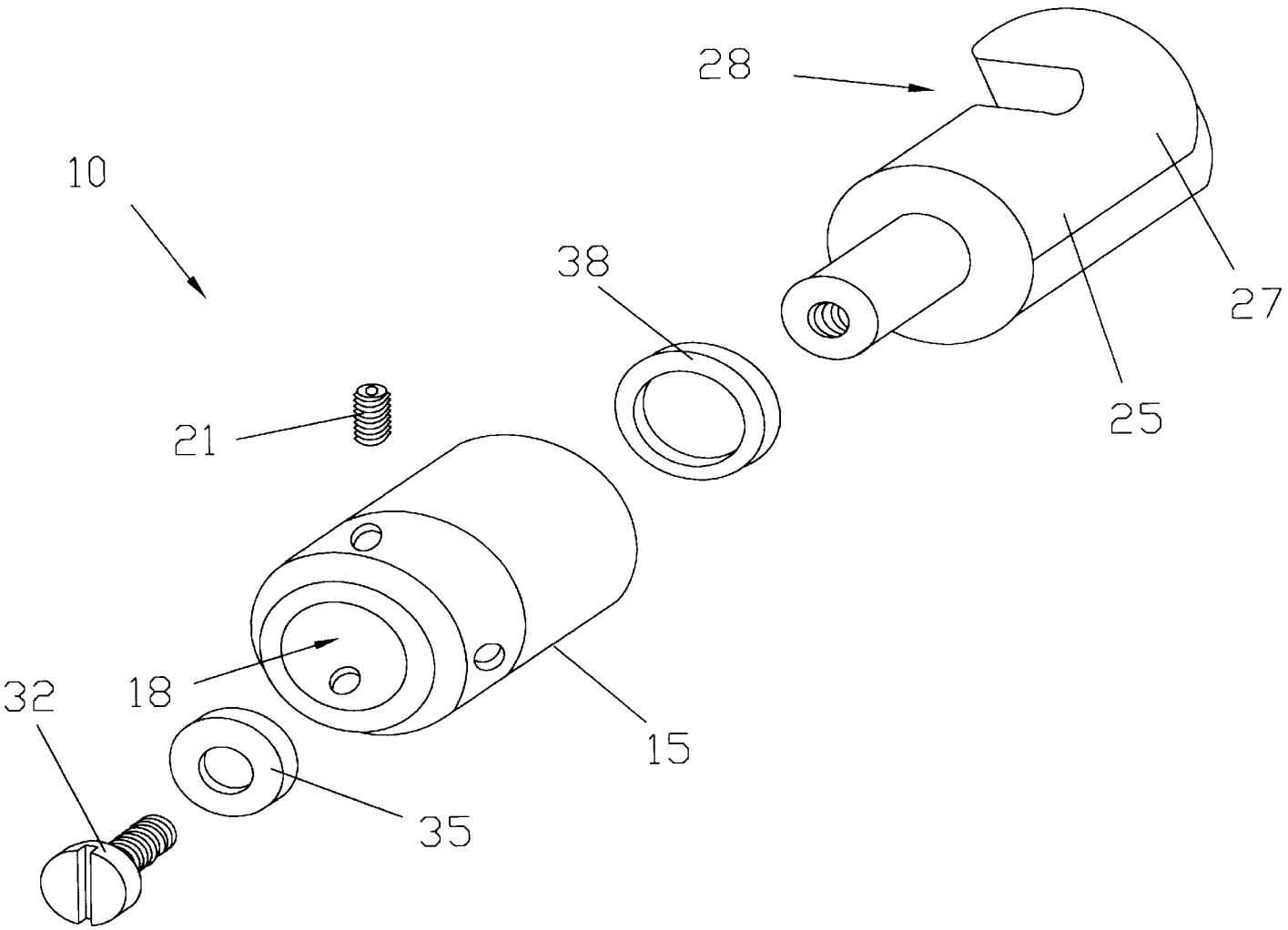
FIG. 4 is an exploded perspective view of the carrying adaptor.
Figure 5:
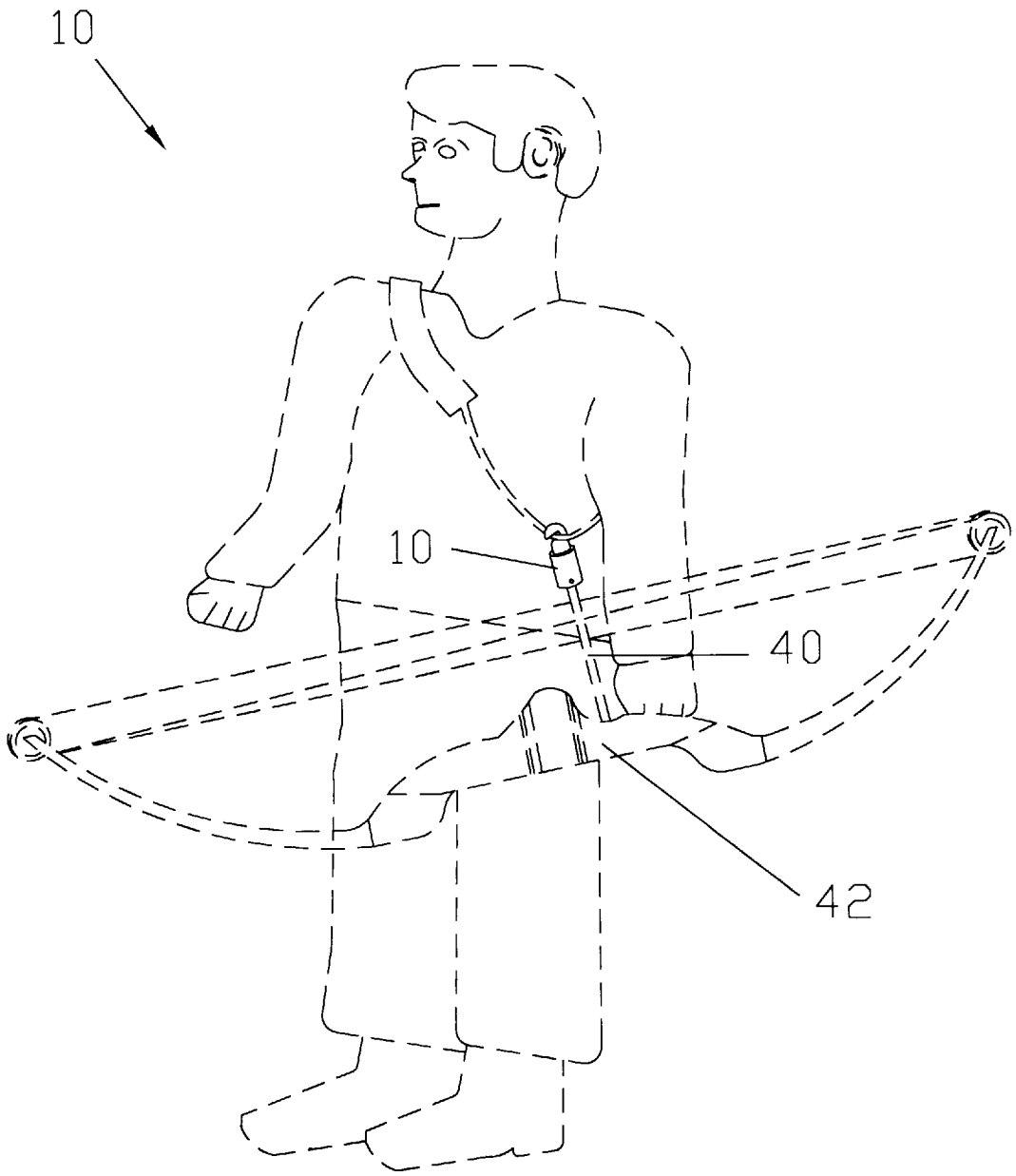
FIG. 5 is a perspective view of a compound bow being held by a person wearing a strap which is hooked to the carrying adaptor.

Referring to the drawings in FIGS. 1–5, in particular, the carrying adaptor 10 for a compound bow comprises an elongate body member 15 having a bore 18 extending therethrough from a first end 16 to a second end 17 of the body member 15 with the bore 18 further having a first portion 18A and a second portion 18B, said first portion 18A further having an annular recessed portion 19 extending the length thereof with the first portion 18A having a larger diameter relative to the diameter of the second portion 18B and being dimensioned to engageably receive an end of the cable bar 40 on a compound bow 42 which is removeably retained in the bore 18 with a fastener member 21 which is threaded through the wall of the body member 15 into the bore 18 to engage the cable bar 40. The elongate body member 15 further has a collar-like detent portion 22 circumferentially disposed about the exterior of the body member 15 near the first end 16 thereof for limiting the movement of a sleeve 20 which is slidably mounted about the exterior of the body member 15.

The carrying adaptor 10 also comprises a catch member 25 which includes a shaft 26 and a hook-like member 27 fixedly attached to a first end of the shaft 26 and having a flexible support member receiving slot 28 therein, which is defined by a curved portion 27A of the hook-like member and is acutely angled relative to the shaft 26 for removeably receiving a flexible support member such as a strap. The catch member 25 is removeably fastened to and longitudinally aligned with the body member 15, with the second end of the shaft 25 being extendable through the second end 17 of the body member 15 and engagable in the second portion 18B of the bore 18 and the hook-like member 27 being in contactable and pivotable relationship with the second end 17 of the body member 15 such that the flexible support member receiving slot 28 can be pivoted to face in any direction desired by the user.

An engaging member 38 such as a rubber O-ring is engagably received in an annular groove which extends in the wall of the body member 15 defining the second portion 18B of the bore 18, for engaging and limiting the rotatable movement of the catch member 25, particularly the shaft 26 of the catch member 25 so that the hook-like member 27 cannot uncontrollably pivot without the user intervening to physically pivot the hook-like member 27 in a desired direction.

The catch member 25 is securely fastened to the body member 15 with a fastening member 30 which has a head portion 32 disposed upon a threaded stem 31 and which is threaded through the second end of the shaft 26 of the catch member 25 disposed inside the second portion 18B of the bore 18, and being extended through a fastening aid 35 such as a washer against which the head 32 of the fastening member 30 is urged as the user threads the fastening member 30 into the catch member 25 and tightens the catch member 25 to the body member 15.

The carrying adaptor 10 is essentially a longitudinal extension of the cable bar 40 since neither the body member 15, the catch member 25, nor the sleeve 20 laterally protrude much beyond the lateral perimeter of the cable bar 40, thus making it more attractive to the user since the user doesn't have to worry about it getting in the way of or hung up on the clothing or even the body of the user.

To use the carrying adaptor 10, the user extends the end of the cable bar 40 through the first end 16 of the bore 18 and threads the fastener member 21 with a tool through the wall of the body member 15 and into engagement with the cable bar 40 to securely fasten the carrying adaptor 10 onto the cable bar 40. The user then can rotate the hook-like member 27 to position the flexible support member receiving slot 28 in the desired direction for conveniently receiving the flexible support member which can be either a strap worn about the shoulder of the user or a belt worn about the waist of the user. The user can then take a portion of the flexible support member and position it in the flexible support member receiving slot 28 and slide the sleeve 20 over the flexible support member receiving slot 28 to substantially prevent the flexible support member from coming out of the flexible support member receiving slot 28.

To unhook the carrying adaptor 10 from the flexible support member, the user slides the sleeve 20 from over the flexible support member receiving slot 28 and simply removes the flexible support member from the hook-like member 27.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A carrying adaptor in combination with a compound bow having a cable bar comprising:

a body member having a bore extending therethrough from a first end to a second end, said body member being at an end of said cable bar, said bore having a first portion and a second portion, said first portion being adapted to receive said end of said cable bar, said body member having an annular recessed portion generally extending the length of said first portion of said bore such that said first portion has a larger diameter relative to said second portion;

a catch member having a hook-like member, said catch member being connected to said body member, for connecting to a flexible support member which is carried upon a user and supports said compound bow; and a sleeve slidably mounted upon an exterior of said body member for retaining said flexible support member to said catch member, said carrying adaptor being coaxially disposed relative to said cable bar.

2. A carrying adaptor in combination with a compound bow having a cable bar as described in claim 1, wherein said catch member further has a shaft, said hook-like member being attached to an end of said shaft.

3. A carrying adaptor in combination with compound bow having a cable bar as described in claim 2, wherein said second portion is adapted to receive said shaft of said catch member.

4. A carrying adaptor in combination with compound bow having a cable bar as described in claim 3, wherein said second portion of said bore has an engaging member therein for engaging said shaft of said catch member for substantially limiting rotational movement of said shaft.

5. A carrying adaptor in combinaton with compound bow having a cable bar as described in claim 4, wherein said engaging member is essentially an O-ring which is received in a groove in a wall defining said second portion of said bore.

6. A carrying adaptor in combination with compound bow having a cable bar as described in claim 4, wherein said body member has a detent portion on the exterior thereof for retaining said sleeve upon said body member.

7. A carrying adaptor in combination with compound bow having a cable bar as described in claim 6, wherein said hook-like member has a curved portion defining a flexible support member receiving slot in said hook-like member, said flexible support member receiving slot being adapted to receive said flexible support member.

8. A carrying adaptor in combination with compound bow having a cable bar as described in claim 7, wherein said sleeve is slidable over said flexible support member receiving slot such that said flexible support member in said flexible support member receiving slot is retained therein by said sleeve.

9. A carrying adaptor in combination with compound bow having a cable bar as described in claim 4, wherein said catch member further includes a fastening member and a fastening aid for fastening said catch member to said body member.

10. A carrying adaptor in combination with compound bow having a cable bar as described in claim 9, wherein said fastening aid is removeably disposed in said first portion of said bore and positionable against said recessed portion.

11. A carrying adaptor in combination with compound bow having a cable bar as described in claim 10, wherein said fastening member is engageable to said fastening aid and threadable in said shaft to fasten said shaft within said bore of said body member such that said hook-like member is in contactable relationship to said body member.

* * * * *